US005467568A

United States Patent [19]

Sieling

[11] Patent Number: 5,467,568

[45] Date of Patent: Nov. 21, 1995

[54] DIMENSIONAL HIP AND RIDGE ROOFING PANEL

[75] Inventor: Frederick W. Sieling, Bound Brook, N.J.

[73] Assignee: Building Materials Corporation of America, Wilmington, Del.

[21] Appl. No.: 179,852

[22] Filed: Jan. 11, 1994

[51] Int. Cl.[6] ..... E09D 1/00

[52] U.S. Cl. ..... 52/518; 52/276; 52/553

[58] Field of Search ..... 52/43, 41, 105, 52/518, 276, 553, 57

[56] References Cited

U.S. PATENT DOCUMENTS 2,429,480 10/1947 Miller ..... 52/276

4,835,929 6/1989 Bondoc et al. ..... 52/518

5,094,042 3/1992 Fieborg ..... 52/57

*Primary Examiner*—Carl D. Friedman

*Assistant Examiner*—Creighton Smith

*Attorney, Agent, or Firm*—Marilyn J. Maue; Joshua J. Ward

[57] ABSTRACT

A bituminous hip and ridge roofing panel having roofing granules on its exposed surface and having folded underlay and overlay sections such that a three dimensional appearance and improved weatherability is achieved upon installation.

17 Claims, 2 Drawing Sheets

DIMENSIONAL HIP AND RIDGE ROOFING PANEL

Figure 1:
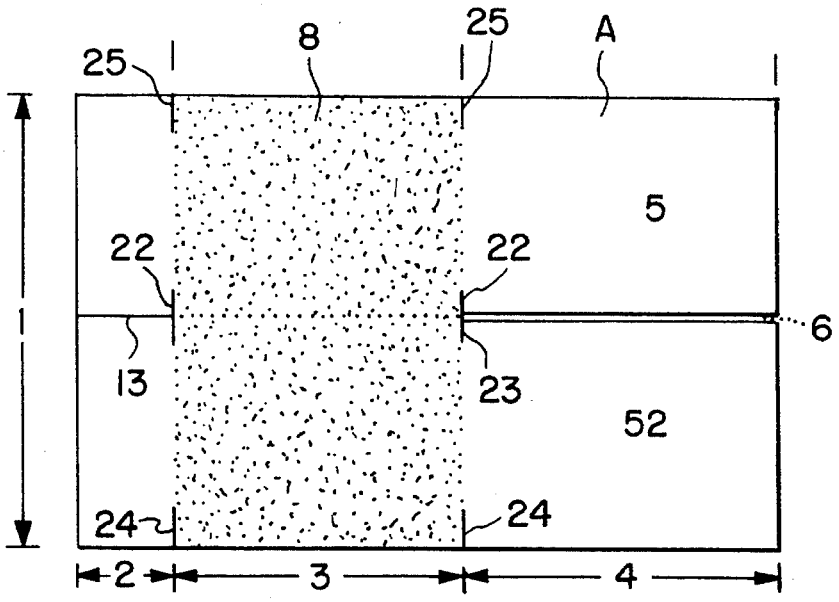
Figure 1A:
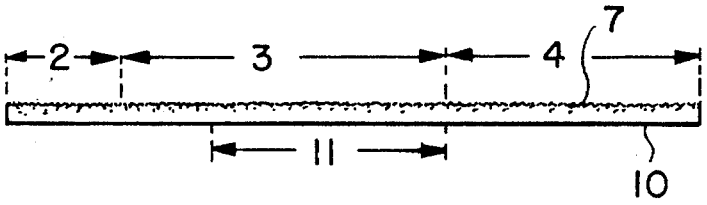
Figure 2:
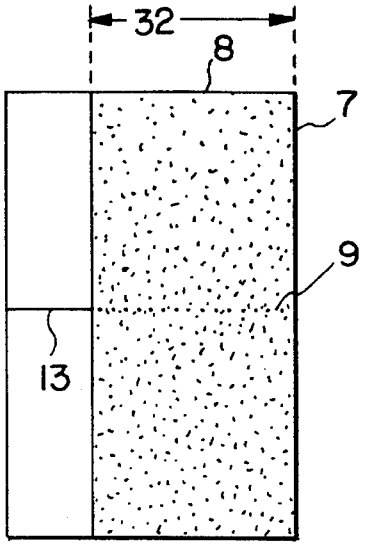
Figure 2A:
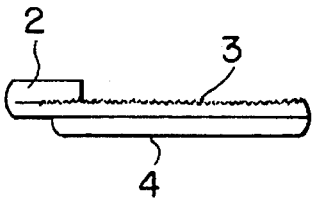
Figure 3:
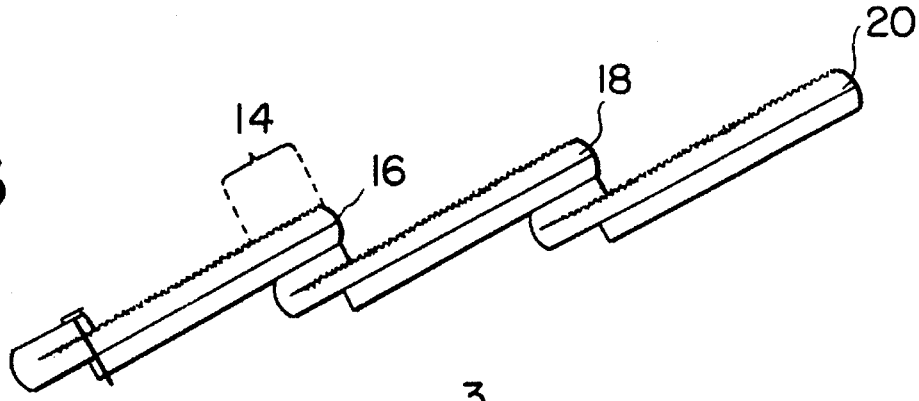
Figure 4:
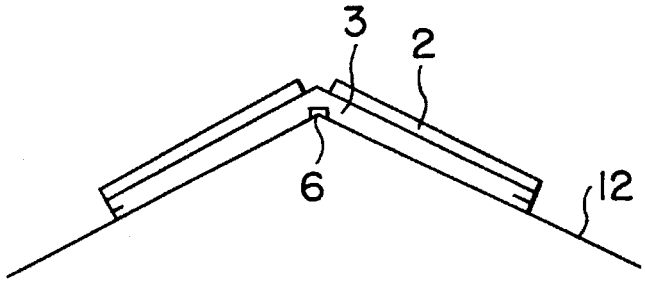
Figure 4A:
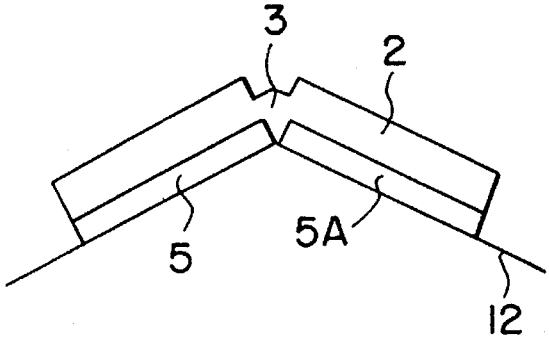
Figure 5:
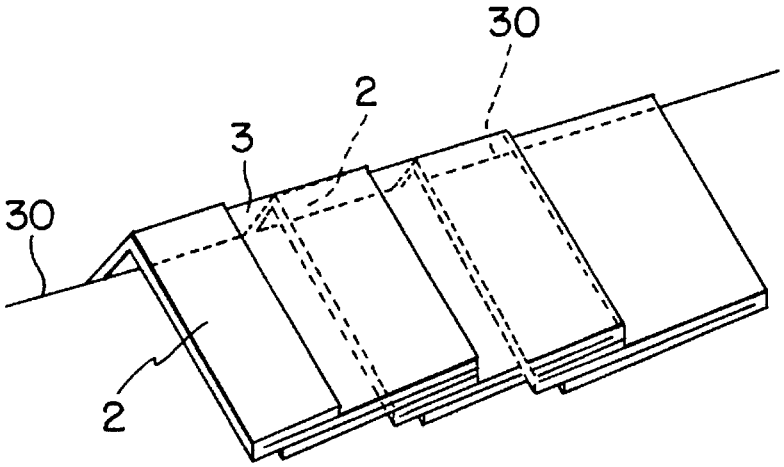

In one aspect this invention relates to an improved ridge and hip roofing panel. In another aspect the invention pertains to a manner of folding said panel to achieve a three dimensional appearance and in yet another aspect the invention relates to a method of installing a succession of said panels.

BACKGROUND OF THE INVENTION

Recent developments in asphalt shingles have, in large measure, overcome their aesthetically unattractive planar appearance by providing visual changes in their design, such as color variations, varied membrane thicknesses or elevation, irregular composite tabs and combinations of the above and other innovations. However, the hip and ridge roof coverings have not kept pace with the dimensional improvements in shingles so that, after installation, the roof does not present a harmonious appearance due to the flatness of the ridge and hip areas.

Ideally, the ridge and hip covers should simulate the shingle design and configuration. An attempt to meet this goal is proposed in U.S. Pat. 3,913,294 which illustrates a rather cumbersome hip and ridge cover panel having increased elevation in its midportion achieved with a series of staggered overlap folds. This solution to the problem has not met with wide acceptance since, in addition to handling and installation difficulties caused by the weight and size of these panels, its single membrane coverage over a major portion of the underlying roof does not provide the desired degree of weather and wind protection in the areas most vulnerable to attack.

Accordingly, it is an object of the present invention to provide a dimensional hip and ridge roofing panel of comparatively light weight which achieves improved protection and ease of installation.

Another object is to provide installed hip and ridge roofing panels which have a pleasing appearance and which are consistent with dimensional roofing shingles.

Another object is to provide a novel process for the installation of a succession of panels.

These and other objects will become apparent from the following description and disclosure.

BRIEF DISCUSSION OF THE DRAWINGS

FIG. I is a top plan form view of hip and ridge panel A as manufactured in an unfolded state. FIG. II is a top planform view of panel A folded in accordance with the present invention.

FIGS. IA and IIA are side cross-sectional views of panel A in flat and folded states respectively.

FIG. III is a cross-sectional view of a plurality of panels mounted in sequence.

FIG. IV and IVA are diagrammatic views of the front and rear portions of panel A installed on a roof ridge, and FIG. V is a perspective view of a series of panels installed on a roof ridge or hip which illustrates the 3 dimensional appearance of the panels of this invention.

THE INVENTION

The present invention relates to an improved dimensional hip and ridge panel having superior pliability, weatherability and ease of installation. The panel is composed of a conventional asphaltic shingle composition, preferably containing between about 0.25 and about 2.0 wt. % plasticizer, e.g. a phthalate ester, to provide the highest pliability to panels having a thickness of between about 0.10 and 0.25 inch. The dimensionality of the present hip and ridge panels is realized by special techniques which involve folding portions of the panel in a manner subsequently described and mounting successive panels in an overlapping manner also described hereinafter.

FIG. I illustrates the flat unfolded panel A of this invention having a width of between about 9 and about 18 inches and an overall length of between about 10 and about 28 inches. The panel is longitudinally sectioned into divided rear section 2, mid exposable section 3 and slotted or notched forward section 4. Rear section 2, having a length of from about 2 to about 5 inches, is horizontally slit along from ⅞ths to its entire length at a point midway of its width. Alternatively, an elongated notch can be substituted for the slit in section 2. The length of section 3 is between about 4 and about 12 inches and section 4 has a length of at least about 1 inch in excess of the exposed portion of section 3. The length of section 4 is critical to the three dimensional appearance of the present hip and ridge panels when installed and can be defined as the length of section 3 minus between about ⅖ and about ⅘ the length of section 2. Section 4 has an elongated notch or slot extending horizontally over from about ⅞ths up to its entire length at a point midway its width, so as to define rectangular subsections 5 and **5*a* which subsections are spaced apart between about 0.25 and about 0.75 inch by means of notch 6. The upper surface 7 of panel A is coated with granules 8 at least on the exposable portion of section 3, as later described. Panel A is adapted to be bent along horizontal dotted line 9** so as to overlay a convex area of a roof, such as a roof hip or ridge.

FIG. IA shows a side view of unfolded panel A which illustrates granulated upper surface 7 and non-granulated under surface 10. Surface 10 may be coated with a standard shingle adhesive material over its entire area or in a portion thereof, as in a strip portion or other configuration.

Alternatively surface 7 can be granulated only in the exposed area 11 of the panel when folded.

FIG. II shows a top view of the folded ridge panel A suitable for installation on a roof. In FIG. II, rear section 2 is folded to overlay a portion of section 3 while notched forward section 4 is folded to underlay section 3 and extends under section 3 to include a portion of section 2. This folded arrangement is more clearly shown in the cross section view, FIG. IIA, where underfolded forward section 4, having a length of in excess of the exposure surface of section 3, provides additional elevation to the panel at a point below section 2. Because of the manner of installing a succession of panels, the exposed surface of section 3, numeral 32, consists of the length of 3 minus the length of 2 in folded position.

FIG. III shows the mounting arrangement of three successive panels, 16, 18 and 20 in cross section, where the leading edge of folded panel 16 completely overlaps section 2 of preceding panel 18 and where the panel overlap is indicated by area 14. Upon mounting, each panel is bent along its midway line 9 to cover the hip or ridge roof area. FIG. III also illustrates the unique dimensional effect where the highest elevation between panels occurs at the overlap mating of five panel membrane thicknesses, i.e. where the membrane sections 3 and 4 of panel 16 overlap membrane sections 2, 3 and 4 of panel 18. The decline portion of each panel is shown where non-overlapped sections 3 and 4 cover the roof ridge. Hence at almost any point, the roof hip and ridge is covered by at least 2 membrane thicknesses to insure good weatherability and protection against wind damage.

FIG. IV shows the front view of a single folded panel installed on the ridge of a roof and FIG. IVA illustrates the rear view of said folded panel, over which the next panel will be subsequently mounted in the manner disclosed in FIG. III.

Each panel can be individually secured to the roof by conventional attachment means, e.g. by nailing folded panel 16 to the roof through sections 2, 3 and 4. The panels can be secured in an alternating manner, if desired, by nailing only one side of a first panel covering the roof ridge and securing the next panel by nailing to the opposite side of the roof ridge; although securing each panel on both sides of the ridge is recommended where the roof is subject to wind lift. The successive panel also can be secured in an unfolded condition to the preceding panel and then folded as shown in FIG. II and IIA.

To facilitate the ease of folding sections 2 and 4 and to provide indica of fold line demarcations, 0.5 to 1.25 inch cuts or incisions at both sides of each slit portion in sections 2 and at both sides of subsections 5 and 5*a*, are illustrated by numerals 22–25 in FIG. I. While not essential, the side cuts of the foldable sections provide a more uniform, finished appearance.

The overlayed section 2 of the folded panel provides easy alignment for the installer in mounting and securing a succeeding panel. Further, the manner of mounting a plurality of panels, achieved by present folding pattern of the panel membrane, assures coverage of nailheads to protect against weathering.

Alternatively, if desired a pair of panels can be joined and secured to a roof, e.g. by opening panel 16 so as to expose the under surface of section 4, nailing section 4 of panel 16 through folded sections 2, 3 and 4 of panel 18 to the roof and then restoring or folding panel 16 to its proper folded position as shown in FIG. IIA.

Where climatic conditions pose no serious threat from wind damage, the panels can be joined or affixed to the roof by adhesive applied on mating surfaces.

FIG. V illustrates the appearance of the present ridge panels when installed over roof ridge 30. Sections 2 and 3 are shown at their fold edges, so that the slitted or notched areas of sections 2 and 4 are not visible. This figure clearly illustrates the pleasing effect of the installed panels which closely simulate installations of slate or wood shakes.

Although any combination of the above section dimensions may be suitably employed to provide the improved hip and ridge panel of this invention, the following are preferred for covering the hip and ridges of a standard TIMBERLINE® roofing shingles*.

| | Inches |
|---|---|
| Overall Width 1 | 10.0–14.0 |
| Length of Section 2 | 2.75–3.25 |
| Length of Section 3 | 7.75–8.25 |
| Length of Section 4 | 6.75–7.25 |

*Supplied by GAF Building Materials having approximately a 5 × 5 inch tab exposure.

Panel proportions consistent with other roofing shingles should be chosen to provide a pleasing appearance and should be in keeping with the dimensions of roofing shingles existing or to be used in the remaining portion of the roof deck. Generally, the most aesthetic effects are achieved by selecting a hip or ridge panel having a length approximately equal and a width approximately twice that of the exposed surface of the existing or selected shingles.

In addition to the above benefits realized by the present ridge and hip covers, including markedly improved weatherability, it will become apparent that the present panels are stronger than those previously employing a multifolded area and are adapted to provide substantial savings in time and materials during installation.

What is claimed is

1. A hip and ridge roofing panel comprising an asphaltic membrane having an upper granulated surface and a non-granulated under surface and having a width of between about 9 and about 18 inches and a length of between about 10 and about 28 inches, said membrane being divided successively into a foldable, longitudinally divided rear section, a mid section having an exposable surface area and a foldable forward section which is longitudinally divided into two substantially equal subsections by a slot or notch extending approximately the length of said forward section and located at a point midway of its width; said forward section having a length equal to the length of said mid section minus between about ⅖th and about ⅘th the length of said rear section.

2. The panel of claim 1 wherein the exposed surface of said mid section is coated with mineral granules effective to prevent damage to said membrane.

3. The panel of claim 1 wherein said rear section has a length of from about 2 to about 5 inches, and said mid section has a length of from about 4 to about 12 inches.

4. The panel of claim 1 wherein said rear section is divided along ⅞ths to its entire length at a point midway of its width by a slit or notch.

5. The panel of claim 4 wherein said membrane has vertical cuts at both sides of the divided portions of said rear section where said longitudinal slit or notch abuts said mid section and vertical slits at both sides of each of said subsections where said subsections abut said mid section.

6. The panel of claim 1 wherein said rear section is folded so as to overlap said mid section and said forward section is folded to underlay said mid section to provide a rear folded area having a rear folded edge and a leading folded area having a folded leading edge.

7. The panel of claim 6 which is adaptable to be bent along its midlongitudinal axis so as to cover a convex area of a roof.

8. The panel of claim 6 wherein said mid section is coated with mineral granules on its exposed upper surface.

9. The panel of claim 6 wherein the folded panel is coated with an adhesive on the under surface of its rear section.

10. The panel of claim 6 wherein said forward section has a length at least 1 inch in excess of the exposed area length of said mid section.

11. The panel of claim 1 wherein the entire upper surface of said membrane is coated with mineral granules.

12. The panel of claim 1 wherein the under surface of said membrane is coated with an adhesive.

13. A process for installing successive panels of claim 6 on a roof which comprises bending a first folded panel along its midlongitudinal axis to cover a convex area of a roof, affixing the rear folded area of said first panel to said roof through its rear folded section, mid section and forward section areas, mounting the leading folded area of a second panel of claim 6 over said first panel so that the leading folded edge of said second panel covers said overlapped mid section of said first panel and affixing said second folded panel to said roof area.

14. The process of claim 13 wherein said successive panel is secured to said first panel and the roof area by nailing the underside of the forward section of the second panel through the rear, mid and forward sections of said first folded panel.

15. The process of claim 13 wherein each panel is secured directly to the roof by nailing through its rear, mid and forward sections.

16. The process of claim 13 wherein the undersurface of each panel is coated with adhesive at least in an area where said panel meets the roof and is adhered to the roof.

17. The process of claim 13 wherein the undersurface of the rear folded area and the leading folded area of each panel is coated with adhesive and each panel is adhered to the roof at the upper surface of said leading forward section and to its adjacent panel at the under surface of said rear section which overlaps said mid section.

* * * * *